US009626945B2

(12) United States Patent
Lowery

(10) Patent No.: US 9,626,945 B2
(45) Date of Patent: Apr. 18, 2017

(54) MODIFIED DRUM HEAD INCORPORATING A SNARE SYSTEM FOR BETTER ARTICULATION OF THE VOICING OF THE SNARE DRUM

(71) Applicant: Eric Brian Lowery, Kernersville, NC (US)

(72) Inventor: Eric Brian Lowery, Kernersville, NC (US)

(73) Assignee: Eric Brian Lowery, Kernersville, NC (US)

( * ) Notice: Subject to any disclaimer, the term of this patent is extended or adjusted under 35 U.S.C. 154(b) by 0 days.

(21) Appl. No.: 14/686,496

(22) Filed: Apr. 14, 2015

(65) Prior Publication Data

US 2016/0307549 A1 Oct. 20, 2016

(51) Int. Cl.
*G10D 13/02* (2006.01)

(52) U.S. Cl.
CPC ..... *G10D 13/025* (2013.01)

(58) Field of Classification Search
USPC ..... 84/417
See application file for complete search history.

(56) References Cited

U.S. PATENT DOCUMENTS 3,186,289 A * 6/1965 Kester, Jr. ..... G10D 13/02 84/411 R
5,204,484 A * 4/1993 Netto ..... G10D 13/025 84/415

* cited by examiner

*Primary Examiner* — Christopher Uhlir

(57) ABSTRACT

The concept of the invention is to take the said top snare assembly of the said double snare system, and to configure the snare system inside of a drum head. By using the said invention, modifications to the said snare drum will not be required and will not compromise the integrity of the original design of the said drum manufacturers' marching snare drum.

1 Claim, 12 Drawing Sheets

11
12
10

10

13
10
14
10

MODIFIED DRUM HEAD INCORPORATING A SNARE SYSTEM FOR BETTER ARTICULATION OF THE VOICING OF THE SNARE DRUM

BACKGROUND OF INVENTION

In previous years, drum manufacturers used a double snare system to better articulate the voicing of the marching snare drum. The said double snare system is configured of two snare systems which consist of a top snare system and a bottom snare system.

The said bottom snare system is located on the lower portion of the snare drum, which is controlled by a snare strainer (Prior Art FIG. 001). The said bottom snare system allows the snares to come into contact with the "top side" of the bottom drumhead (This system is standard throughout the percussion industry).

The said top snare system (Prior Art FIG. 003) is located on the inside of the upper portion of the marching snare drum, which is also controlled by a snare strainer (Prior Art FIG. 002). The mounting location of the said top snare system is positioned so that the snares from the said top snare system can allow for proper contact with the "bottom side" of the top drumhead.

In order for the said top snare system to be mounted, the drum manufacturers have to slightly modify the design of their exiting marching snare drums, by using cut-out notches (Prior Art FIG. 004) in order to accommodate for the mounting of the said top snare system.

BRIEF SUMMARY OF INVENTION

The subject components in this invention are used to create a rattling/buzzing sound in the form of a modified drum head. These said components will vibrate, project through, and out of the snare drum. The said components will have the means for better articulating the voicing of the said snare drum, while eliminating the costly and design compromising effects of a top snare system associated with the double snare system marching snare drum. The invention will provide an easy upgrade option to the single snare system for the end consumer, without the purchase of the said double snare system marching snare drum.

1) The said drum head film.

2) Holes that line the border of the said drum head film.

3) The bearing edge of the said drum head film (this bearing edge will be raised 0.25 inches higher than the standard bearing edge height).

4) Trim lines of the said drum head film.

Figures 2, 2B, 2C:
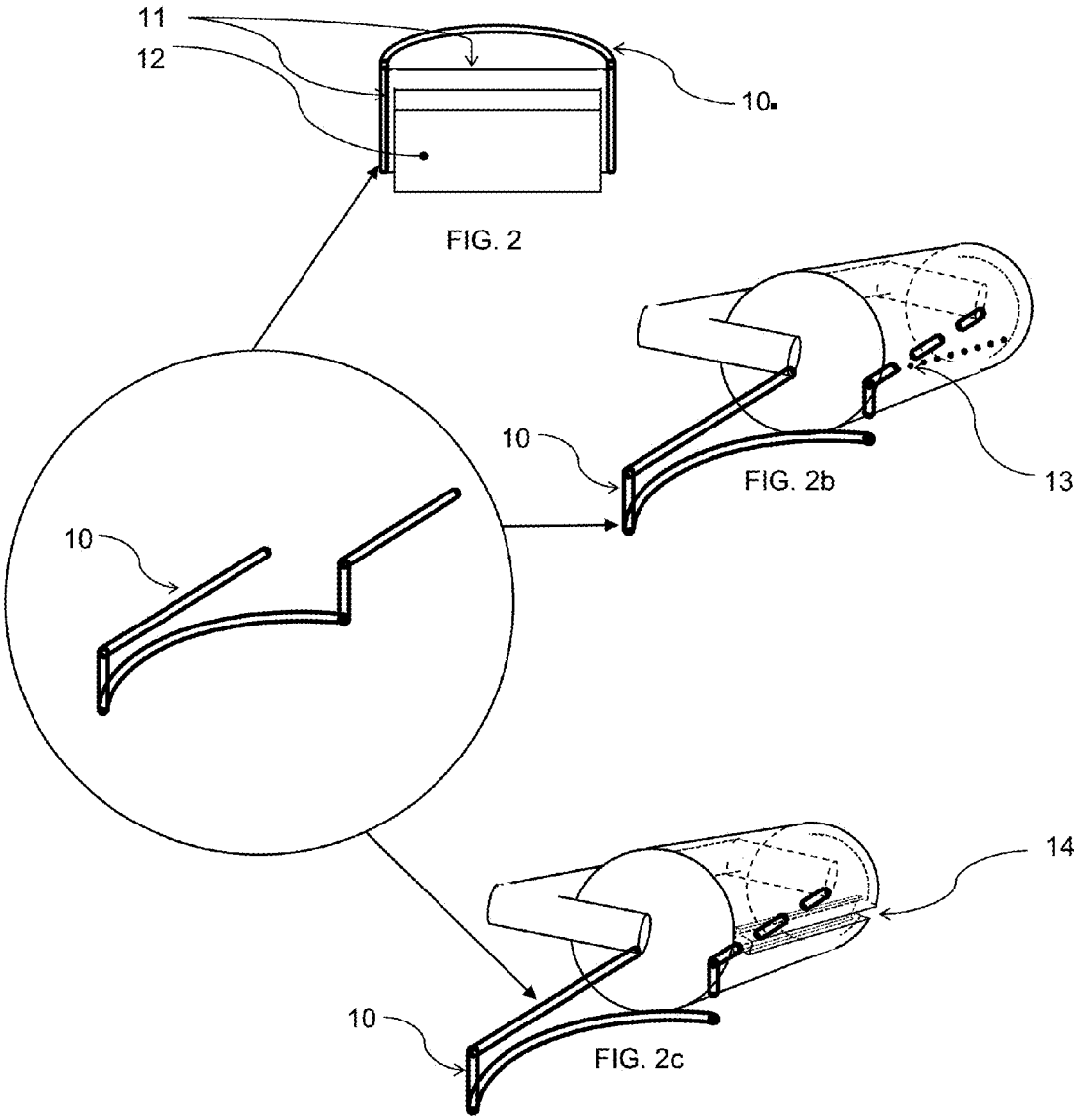

FIG. 2: Snare roller mounting assembly. (Sub-FIGS. 10 and 11 will be injection molded into a single stationary unit to form FIG. 2).

Figure 6:
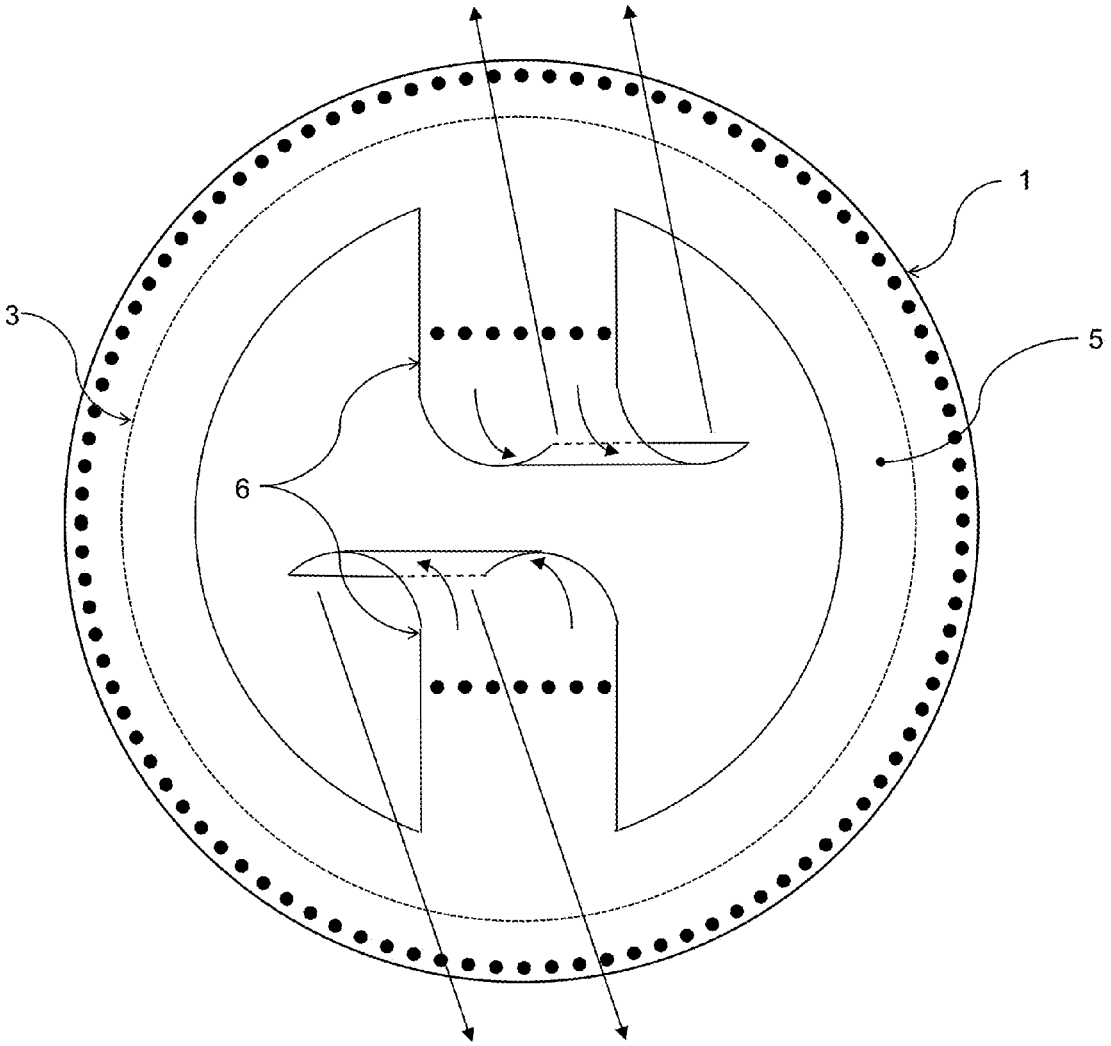

10) Squared c-shaped mounting bracket for receiving FIG. 6-(6).

Figure 3:
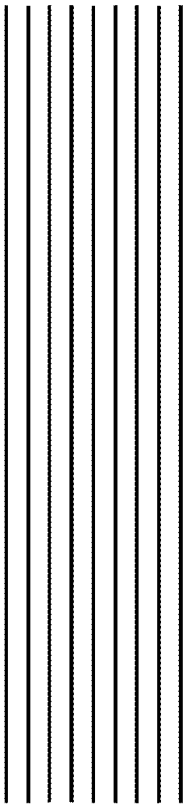
Figure 3B:
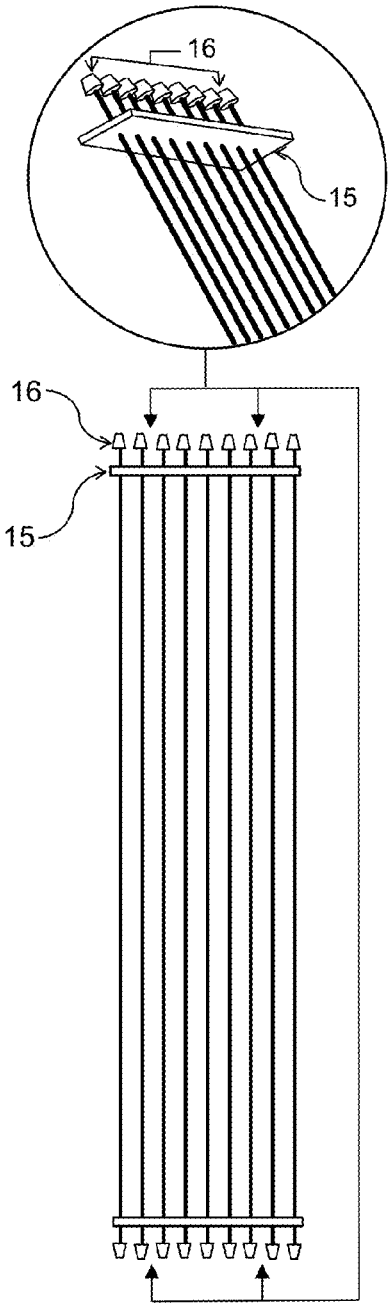
Figure 3C:
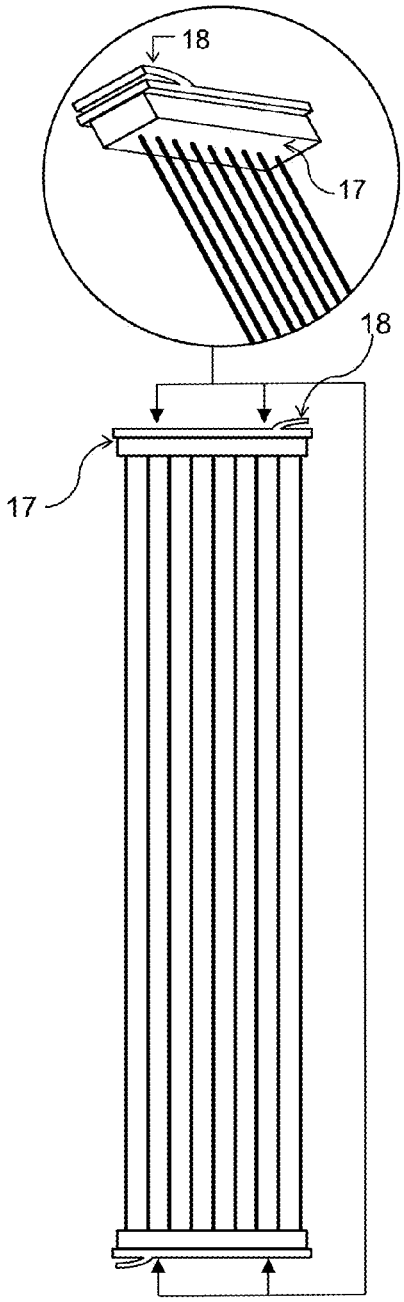

11) Snare roller for receiving either of the said snare assemblies (see FIG. 3*b* and FIG. 3*c*).

Figure 5:
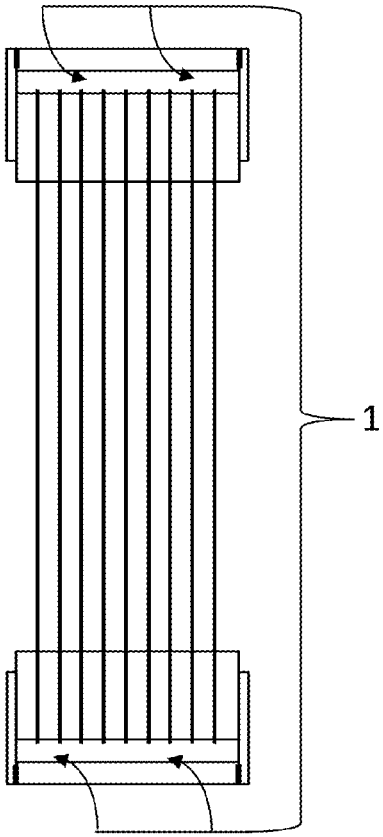

12) Tension bracket for providing proper tension and to retain the correct positioning of the said FIG. 5 in relation to the "bottom side" of the said top drum head.

FIG. 2*b*: The said FIG. 2 will be drilled with up to 20 holes expanding the width of said FIG. 2-(11).

13) The said holes for receiving FIG. 3*b*.

FIG. 2*c*: The said FIG. 2 will be cut/or molded with a t-shaped slot for receiving FIG. 3*c*.

14) The said t-shaped slot with an opening at one end of said FIG. 2 for receiving FIG. 3*c*.

FIG. 3: The said snare wires (up to 20 wires). (The said snare wires cannot stand alone and will have to be fitted with either 3*b* or 3*c* on both ends to complete the make-up the snare wire assembly).

FIG. 3*b*: The said snare wires fitted with beaded tips and stabilizer bar (enlarged for better view):

15) Trapezoid beaded tips.

16) Snare wire stabilizer bar.

FIG. 3*c*: The said snare wires fitted with a t-shaped sliding lock bar (enlarged for better view):

17) T-shaped slide bar.

18) Locking tab.

Figure 4B:
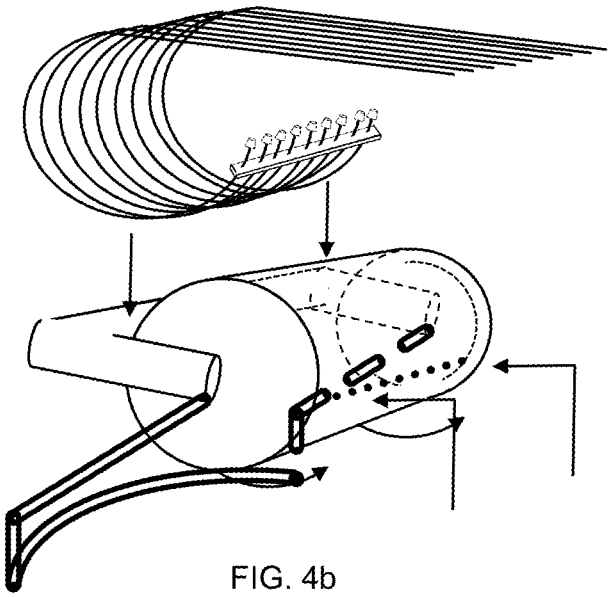

FIG. 4*b*: Assembly diagram of said FIG. 2*b* and said FIG. 3*b*.

Figure 4C:
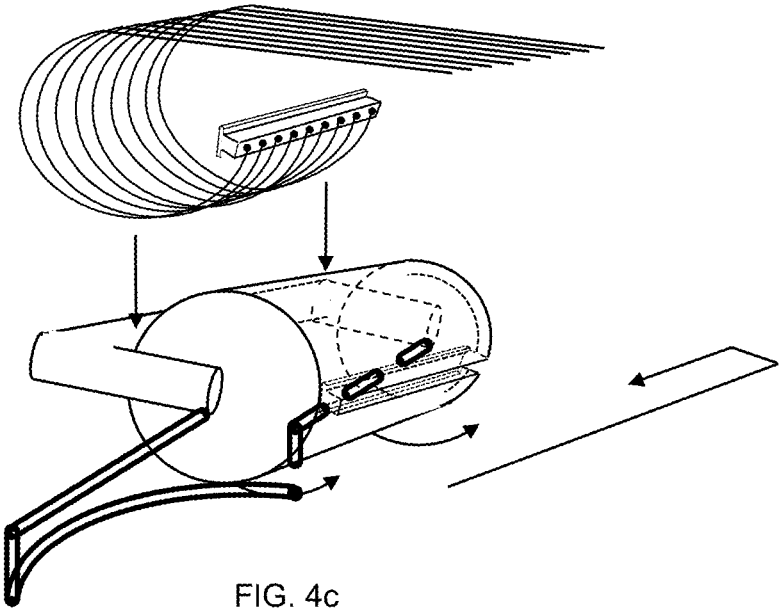

FIG. 4*c*: Assembly diagram of said FIG. 2*c* and said FIG. 3*c*.

FIG. 5: Shows the top view of the completed assembly of both the said FIGS. 3*b* and 3*c*.

Arrows depicts how the said mounting tabs [FIG. 6-(6)] will be inserted over the top; and pulled back of said FIG. 2-(10)

Figure 5B:
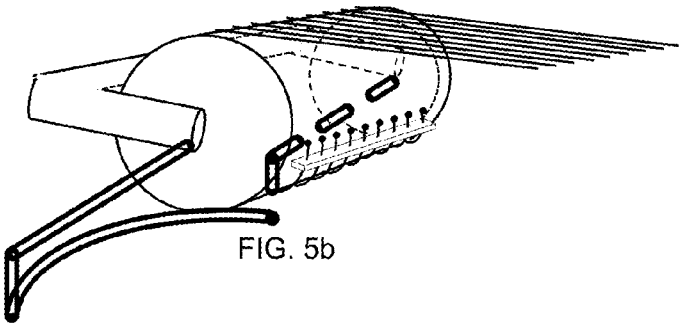

FIG. 5*b*: Shows an angled view of the said FIGS. 2*b* and 3*b* once assembled.

Figure 5C:
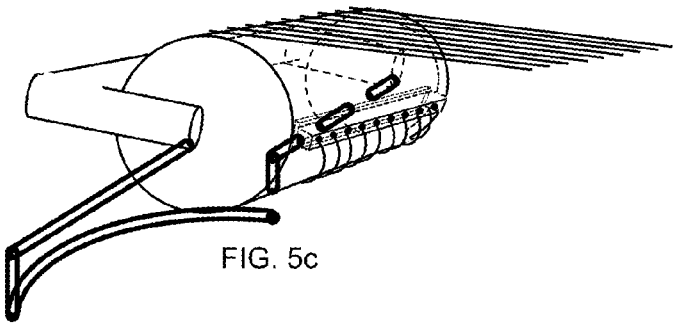

FIG. 5*c*: Shows an angled view of the said FIGS. 2*c* and 3*c* once assembled.

FIG. 6: Shows the said FIG. 1 once lines have been said trimmed.

1) The said drum head film showing the said holes along border of said drum head film.

Figure 1:
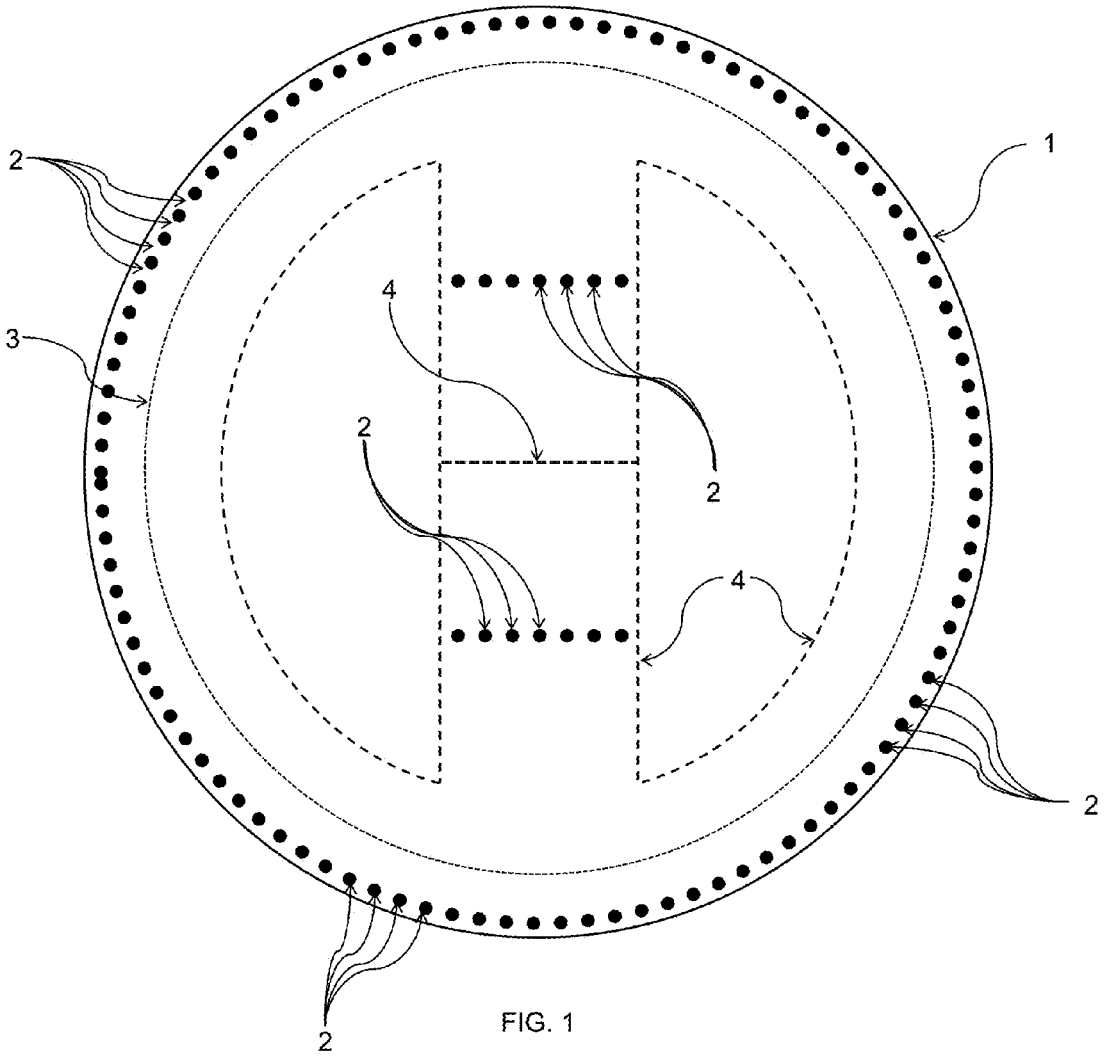
FIG. 1: Pattern layout of said drum head film.

5) The said rest border formed after the said lines of said FIG. 1-(4) has been trimmed.

6) The said mounting tabs and holes formed after said line of said FIG. 1-(4) has been said trimmed.

3) The said bearing edge that was formed after said FIG. 1 has been pressed into shape.

Figure 7:
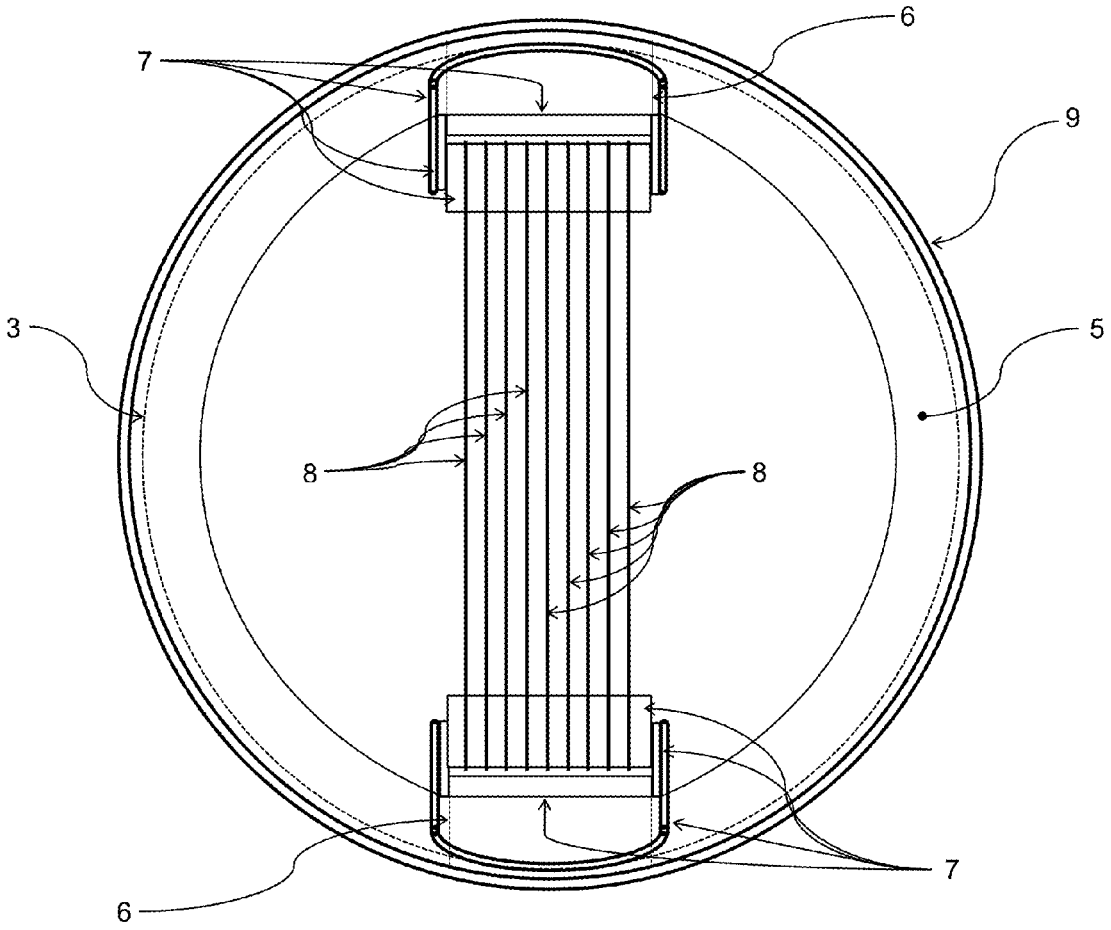

FIG. 7: The completed assembly of all components of: (FIGS. 1 through 6)

9) The said drum head frame.

5) The said rest border.

6) The said mounting tabs.

3) The said bearing edge.

7) The said snare roller mounting assemblies.

8) The said snare wire assembly.

Figure 8:
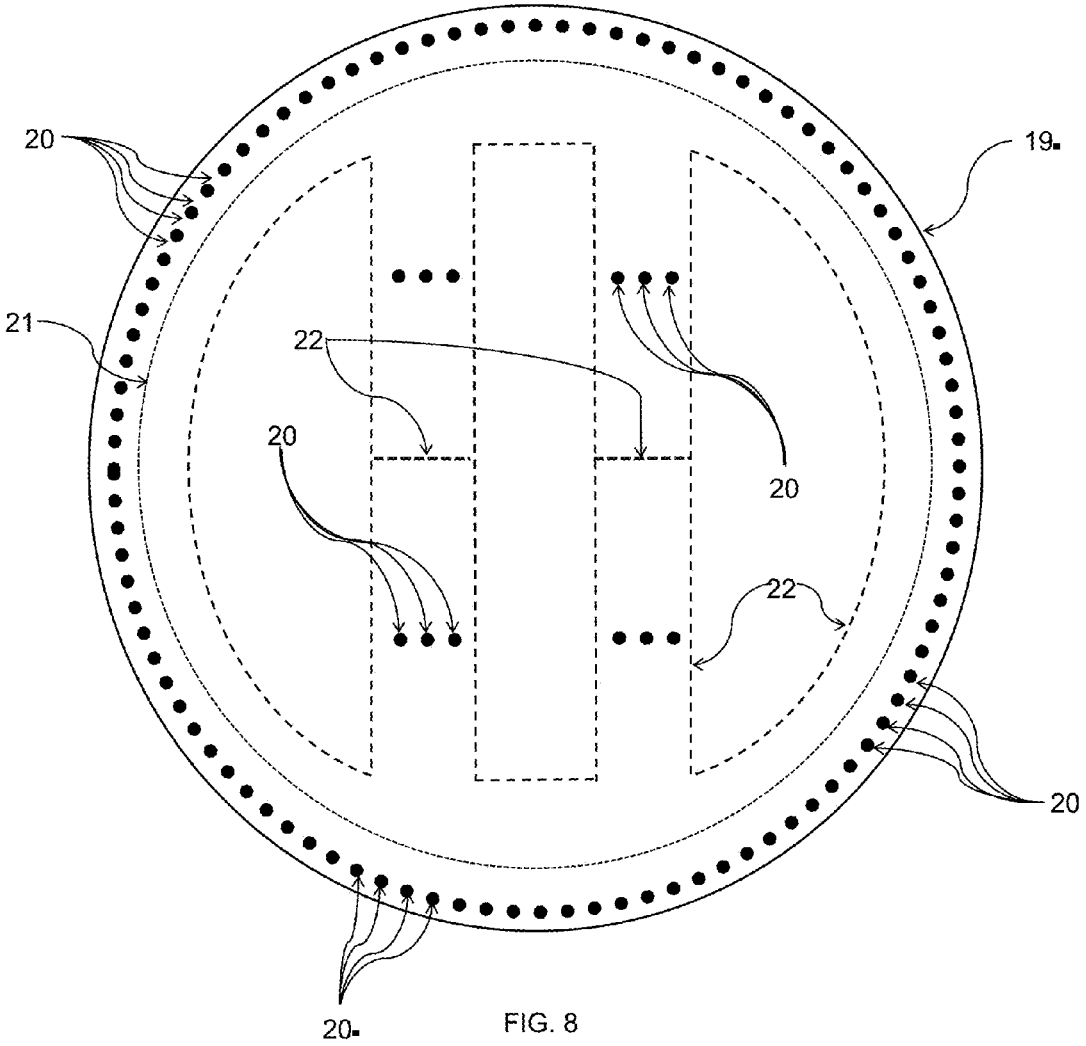

FIG. 8: Pattern layout of said drum head film.

19) The said drum head film.

20) The said flow through holes.

21) The said bearing edge (this bearing edge will be raised 0.25 inches higher than the standard bearing edge height).

22) The said trim lines.

Figure 9:
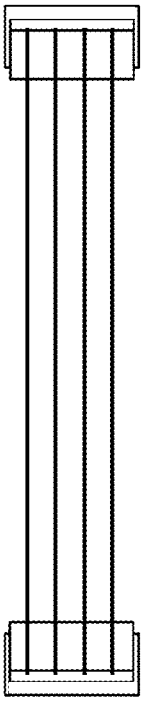

FIG. 9: Smaller version of said snare assembly (see FIG. 5).

Figure 9B:
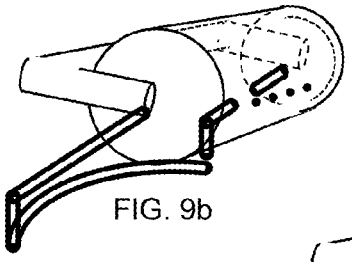

FIG. 9*b*: Smaller version of said FIG. 2*b* with up to 10 holes.

Figure 9C:
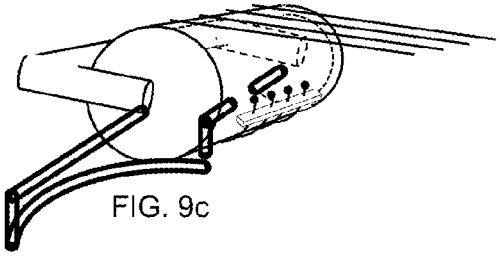

FIG. 9*c*: Smaller version of said assembled FIGS. 2*b* and 3*b* (see FIG. 5*b*).

Figure 9D:
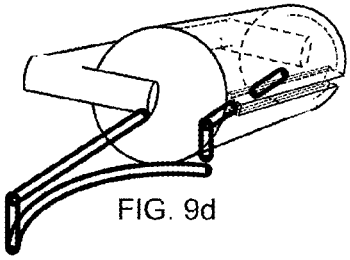

FIG. 9*d*: Smaller version of said FIG. 2*c* with shorter slot.

Figure 9E:
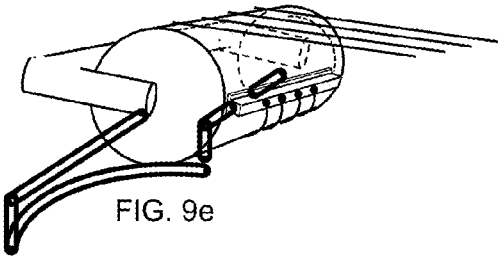

FIG. 9*e*: Smaller version of said assembled FIGS. 2*c* and 3*b* (see FIG. 5*c*).

Figure 10:
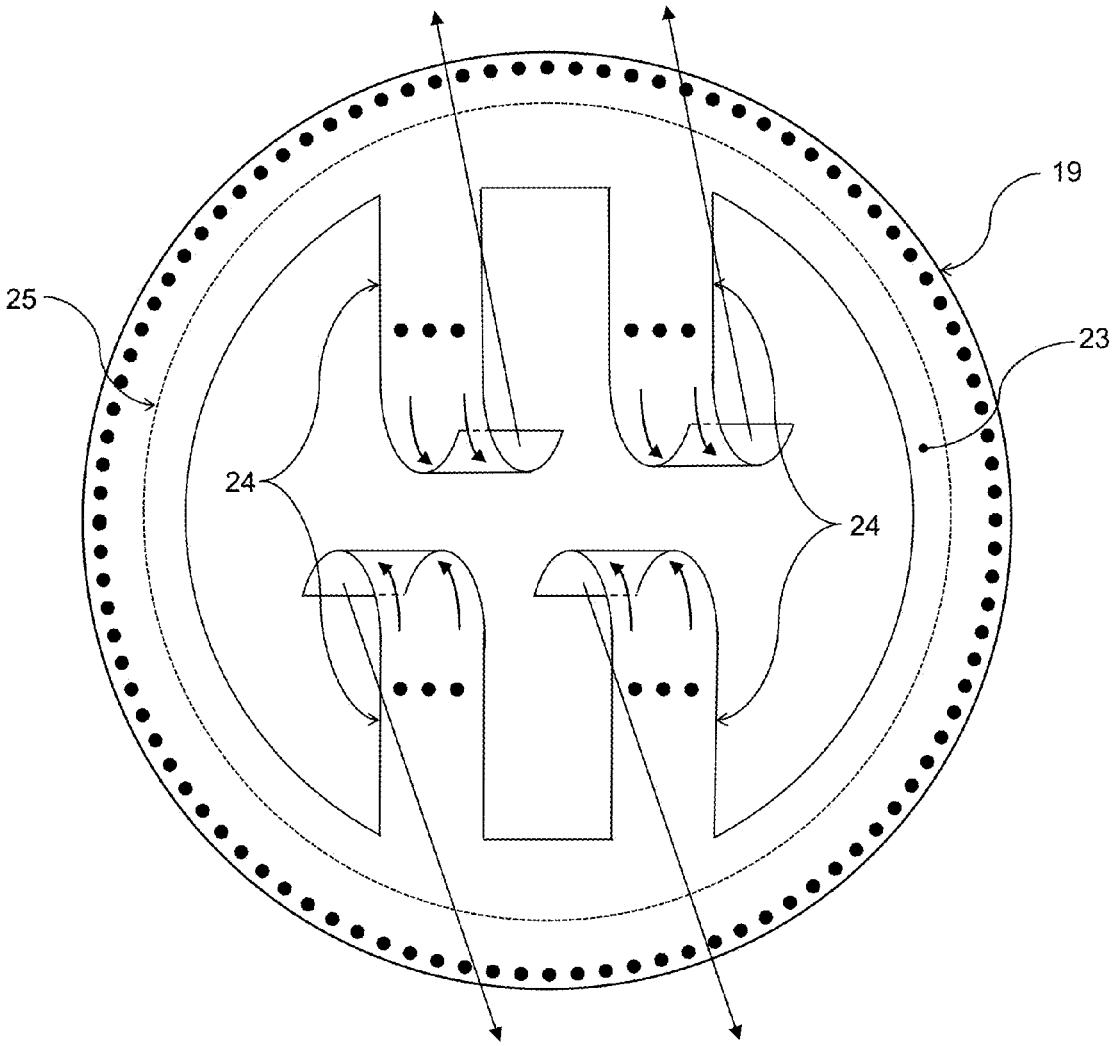

FIG. 10: Shows said FIG. 8 once lines have been said trimmed.

19) The said drum head film.

23) The said rest border.

24) The said mounting tabs.

26) The said bearing edge.

Figure 11:
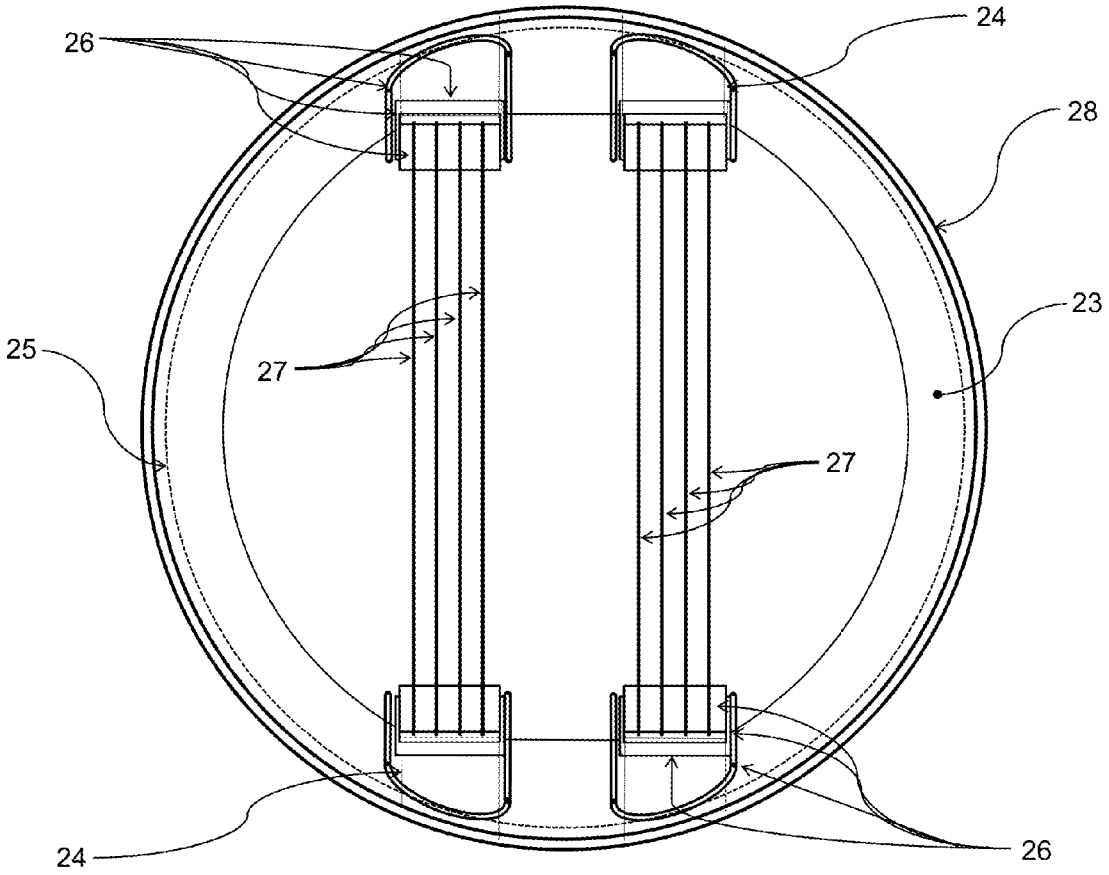

FIG. 11: The completed assembly of all components of: (FIGS. 8 through 10)

28) The said drum head frame.

23) The said rest border.

24) The said mounting tabs.

25) The said bearing edge.

26) The said snare roller mounting assemblies.

27) The said snare wire assemblies.

Figure 12:
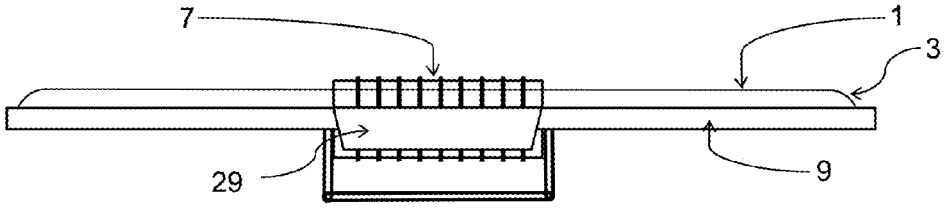

FIG. 12: Front side view of said FIG. 7.

10) The said drum head frame.

1) The said drum head film.

3) The said border.

8) The said snare roller mounting assembly.

29) Manufacturer's name plate.

Figure 13:
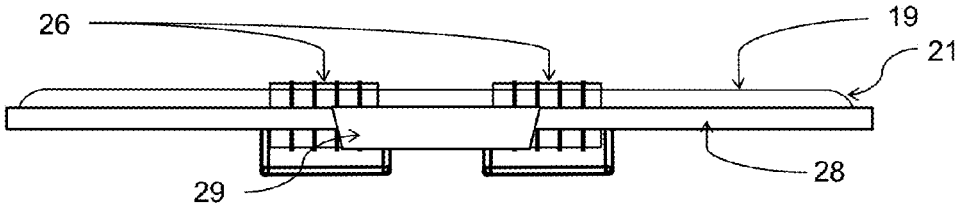

FIG. 13: Front side view of said FIG. 11.

28) The said drum head frame.

19) The said drum head film.

21) The said border.

26) The said snare roller mounting assemblies.

29) The said manufacturer's name plate.

Figure 14:
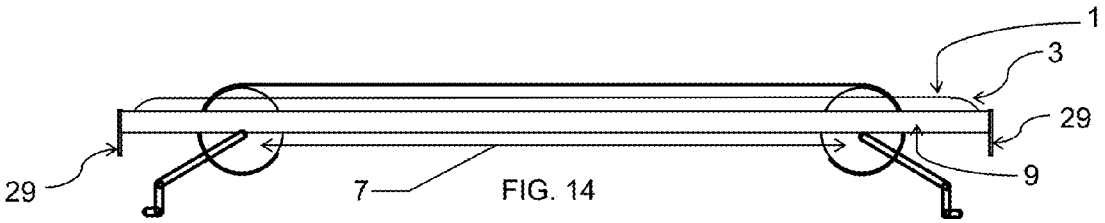

FIG. 14: Left/Right side view of said FIG. 7 and said FIG. 11.

10) The said drum head frame.

1) The said drum head film.

3) The said border.

8) The said snare roller mounting assemblies.

29) The said manufacturer's name plate.

DETAILED DESCRIPTION OF THE INVENTION

The said invention will start out as a Mylar, Kevlar, Nylon or Aramid Fiber sheet. Then will be trimmed to the exact specifications mentioned in said FIGS. 1 and 7.

The components of said FIG. 2 will be molded into a single unit whether using the design of said FIG. 2*b* or 2*c*. The said FIG. 2-(12) will be bent at a 45 degree angle, then down a 270 degree angle, then over a 180 degree angle (This angle will be contoured to fit the inside radius of the of the drum shell)., then up a 90 degree angle, then over to a 45 degree angle. The said FIG. 2*b* will have up to twenty holes drilled expanding the width to form said FIG. 2-(11). The said FIG. 2*c* will have a t-shaped slot molded to form said FIG. 2-(11). The said FIGS. 2, 2*b* and 2*c* will be made of one or more of the following materials: Acrylonitrile-Butadiene-Styrene (ABS) Plastic; Carbon Fiber Reinforced Thermoplastics; Recycled Plastics; Acrylic; Nylon; and Aluminum. The Said FIG. 2-(12) could also be made of Steel wire.

The components of said FIGS. 3*b* and 3*c* will be made of one or more of the following materials concerning the t-shaped sliding lock bar; trapezoid beaded tips as well as the stabilizer bar: Acrylonitrile-Butadiene-Styrene (ABS) Plastic; Carbon Fiber Reinforced Thermoplastics; Recycled Plastics; Acrylic; Nylon; and Aluminum. The said snare wire could be made of Nylon string (used in tennis rackets), and Steel wires whether strait or zigzagged.

Once the said FIG. 2*b* has been drilled, the said FIG. 3*b* will be assembled into said FIG. 2*b*. Whereas said FIG. 3*b* will go through the air spaces in between said FIG. 2-10) and said FIG. 2-11) (refer to FIG. 5) on both sides. Then will be pulled underneath said FIG. 2-1*b*). Then will be pressed into the said holes of said FIG. 2*b* (refer to FIG. 4*b*).

Once the said FIG. 2*c* has been molded, the said FIG. 3*c* would be assembled into said FIG. 2*c*. Whereas said FIG. 3*c* will go through the air spaces in between said FIG. 2-10) and said FIG. 2-11) (refer to FIG. 5) on both sides.

Then will be pulled underneath said FIG. 2-1*b*); then pulled sideways; then inserted into the slot of said FIG. 2*c* (refer to FIG. 4*c*).

The following procedure will be to take the said Figures of 6-(6) then insert them through the air spaces in between said FIG. 2-10) and said FIG. 2-11) (refer to FIG. 5) on each side. Then the said Figures of 6-(6) will be pulled back toward the edge of the FIG. 1-(1) to line up with the said FIGS. 1-(2). Once said Figures of 6-(6) are lined up with said FIGS. 1-(2), the whole assembly will be inserted into said FIG. 7-(9). The said FIG. 7-(9) will be made of one of the following materials: Mylar, Kevlar, Nylon, Aramid Fiber, and Aluminum. The excess material will be trimmed and discarded. The Mylar, Kevlar, Nylon and Aramid Fiber sheets could also be rolled on the edge to form the frame and drum head film into a single unit. In using this approach, the holes described in FIGS. 1-(2) and 8-(20) will no longer be required.

This will conclude the assembly of said FIG. 7. The same sequence of procedures will be applied to the said FIG. 11 using the said FIGS. 8 through 11.

Upon completion, the assembled said invention will then be placed directly onto the said bearing edge of the drum with the said tension brackets positioned on the inside of the said drum shell. Once the said invention is properly positioned on the said drum, the Batter Drum Head will then be placed directly on top of the said invention.

After the said Batter Drum Head is placed on top of the said invention, tightening and tuning of the said Batter Drum Head would resume in its normal method.

Once the tightening of the said Batter Drum Head begins, the mounting tabs [FIG. 6-(6)] will then begin to stretch over the bearing edge of the snare drum. This counter pressure will create the tension that is needed to allow the said tension brackets (FIG. 2-(12) as well as the said snare assembly (either FIG. 4*b* or 4*c*) to properly remain in contact with the "bottom side" of the said Batter Drum Head.

The invention claimed is:

1. A modified drum head that supports and houses a snare system comprised of:

a) a drum head frame;

b) a drum head film;

c) one or two snare wire assemblies, d) two or four snare roller mounting assemblies; and e) two or four tension brackets which are connected to the roller mounting assemblies; whereby said drum head film is trimmed, forming a rest border; and two or four separate mounting tabs for mounting said snare wire assemblies, and said snare roller mounting assemblies, said drum head film is further pressed to form a bearing edge once said snare wire assemblies, snare roller mounting assemblies, and tension brackets are assembled in correct positions respectively.

* * * * *